US007031484B2

(12) United States Patent
Ludvigsen

(10) Patent No.: US 7,031,484 B2
(45) Date of Patent: Apr. 18, 2006

(54) SUPPRESSION OF PERCEIVED OCCLUSION

(75) Inventor: Carl Ludvigsen, Valby (DK)

(73) Assignee: Widex A/S, Vaerlose (DK)

( * ) Notice: Subject to any disclaimer, the term of this patent is extended or adjusted under 35 U.S.C. 154(b) by 126 days.

(21) Appl. No.: 09/899,989

(22) Filed: Jul. 9, 2001

(65) Prior Publication Data

US 2002/0150269 A1 Oct. 17, 2002

(30) Foreign Application Priority Data

Apr. 13, 2001 (DK) ..... 2001 00607

(51) Int. Cl.
*H04R 25/00* (2006.01)

(52) U.S. Cl. ..... 381/316; 381/312

(58) Field of Classification Search ..... 381/71.1, 381/60, 312, 317, 80, 316, 320
See application file for complete search history.

(56) References Cited

U.S. PATENT DOCUMENTS

| | | | | |
|---|---|---|---|---|
| 4,852,175 | A * | 7/1989 | Kates | 381/312 |
| 5,500,902 | A | 3/1996 | Stockham, Jr. et al. | |
| 6,240,192 | B1 * | 5/2001 | Brennan et al. | 381/314 |
| 6,873,709 | B1 * | 3/2005 | Hou | 381/106 |
| 2002/0118851 | A1 * | 8/2002 | Paludan-Mueller | 381/317 |

FOREIGN PATENT DOCUMENTS

| | | |
|---|---|---|
| WO | WO 98/47313 | 10/1998 |
| WO | WO 98/56210 | 12/1998 |

OTHER PUBLICATIONS

Lunner et al: "A Digital Filterbank Hearing Aid Design, Implementation and Evaluation" International Conference on Acoustics, Speech & Signal Processing. ICASSP, US, New York, IEEE,vol. CONF. 16, May 14, 1991, pp. 3661-3664.

* cited by examiner

*Primary Examiner*—Suhan Ni
(74) *Attorney, Agent, or Firm*—Sughrue Mion, PLLC

(57) ABSTRACT

A fitting method is provided for a multichannel hearing aid with at least one low frequency channel having an individually adjustable compressor. The method comprises the steps of first adjusting the characteristic of the compressor according to the hearing loss to be compensated by the hearing aid, followed by the step of increasing the compression ratio of the characteristic of the compressor in the at least one low frequency band. The at least one low frequency channel may further comprise an offset amplifier adding an offset gain to the compressor characteristic, and the method may further comprise the step of adjusting the offset gain in the range from −20 dB to 20 dB. After adjustment according to the method, compressors operating at low frequencies enhance low level signals and attenuate high level signals whereby perception of occlusion is suppressed.

11 Claims, 6 Drawing Sheets

SUPPRESSION OF PERCEIVED OCCLUSION

FIELD OF THE INVENTION

The present invention relates to a hearing aid with means for suppression of perceived occlusion.

BACKGROUND OF THE INVENTION

The occlusion effect denotes the low frequency enhancement in the loudness level of bone conducted signals due to occlusion of the ear canal. Some users having an earmold or a hearing aid in the ear canal blocking the canal complain that they have a perception of being in a barrel. In particular, their own voice sounds as if they speak in a barrel.

FIG. 1 shows plots of sound pressure level (SPL) in the ear canal as a function of frequency for a sound with a specific frequency spectrum. SPL is the quantity of sound energy relative to a reference pressure: 20 μPa. The plotted SPL is measured in two situations. Curve 1 shows SPL measured in the occluded ear canal, and curve 2 shows SPL measured in the non-occluded ear canal. It is shown that for low frequencies, the SPL is approximately 10–30 dB higher for an occluded ear canal than for a non-occluded ear canal. The plotted curves are adopted from "The hollow voice occlusion effect", M. Killion, FIG. 6, "Hearing aid fitting", J. Jensen, p. 231, 13'th Danavox Symposium, 1988.

Sounds produced in a person's throat are transmitted to the person's ear canal by bone conduction. The elastic cartilaginous tissue in the ear canal transforms the bone conducted energy to acoustic waves in the ear canal. Speech transmitted to the ear canal in this way is denoted bone conducted speech.

It is known to suppress the occlusion effect by inserting the hearing aid earmold or housing deeply in the ear canal, i.e. in the bony part of the ear canal. This reduces the occlusion effect since the sealed volume of the ear canal is isolated from the cartilaginous tissue transforming bone conducted speech to acoustic waves. However, the bony part of the ear canal is typically very sensitive and positioning of a mechanical member in this part of the ear canal may be uncomfortable to the user.

It is also well known to provide a vent in the earmold or hearing aid housing allowing bone conducted sound to escape from the ear canal. The vent is typically a tube extending through the earmold or hearing aid housing facilitating transmission of acoustic waves from one side to the other so that the ear canal is not completely blocked. However, the vent may cause acoustic feedback. Acoustic feedback occurs when the microphone of a hearing aid receives the acoustic output signal generated by the receiver. Amplification of the received signal may lead to generation of a stronger acoustic output signal and eventually the hearing aid may oscillate. In hearing aids residing completely in the canal (CIC hearing aids), the short distance between microphone and receiver leads to low attenuation of acoustic waves transmitted from the receiver to the microphone. The attenuation increases with decreasing vent diameter and increasing vent length. Thus, occlusion and feedback impose opposite requirements on vent geometry.

SUMMARY OF THE INVENTION

It is an object of the present invention to provide a hearing aid with signal processing means for suppression of the occlusion effect.

It is a further object of the present invention to provide a fitting method leading to a suppression of a hearing aid user's perception of the occlusion effect.

Research by the present inventors has shown that in some listening situations, hearing aid users perceive an improvement in sound quality when low frequency bands are enhanced, i.e. the above-mentioned "barrel perception" becomes less noticeable. However, in some other listening situations, e.g. during conversation, the hearing aid user perceives an improvement in sound quality when low frequency bands are attenuated, probably because of amplification of bone conducted speech.

The present invention exploits the fact that the eardrum of a user receives the user's own speech from two different propagation paths. In addition to the bone conducted speech mentioned above, sound waves also propagate through air from the mouth and around the head to the ear where it is received by the hearing aid. Also for air conducted speech, low frequencies are enhanced since the head attenuates high frequencies leaving low frequencies unaffected.

This is further illustrated in FIG. 2 showing plots of SPL in a non-occluded ear canal as a function of frequency for a sound with a specific frequency spectrum. Curve 3 is SPL generated by the person himself, and curve 4 is SPL generated by another person. At low frequencies, there is a difference in SPL of approximately 10–15 dB between a person's own speech and the speech of another person.

According to the present invention, a hearing aid is provided wherein a user's own speech is attenuated at low frequencies whereby the sum of air conducted and bone conducted speech is also attenuated. A suppression of the occlusion effect during conversation is hereby obtained since the sum of bone and air conducted speech has been reduced to a level that is closer to the sum level in a non-occluded ear canal. The user's own speech is discriminated from another person's speech by the signal level at low frequencies.

Further, in listening situations, low signal frequencies are enhanced whereby suppression of the occlusion effect in listening situations is obtained.

Thus, according to the present invention, a fitting method is provided for a multichannel hearing aid with at least one low frequency channel having an individually adjustable compressor. The method comprises the first step of adjusting the characteristic of the compressor according to the hearing loss to be compensated by the hearing aid. The method is characterized by the succeeding step of increasing the compression ratio of the characteristic of the compressor in the at least one low frequency band.

A multichannel hearing aid comprises at least one input transducer for transforming an acoustic input signal into a first electrical signal, a first filter bank with bandpass filters for dividing the first electrical signal into a set of bandpass filtered first electrical signals, a processor for generation of a second electrical signal by individual processing of each of the bandpass filtered first electrical signals, e.g. for amplification with different gains, and adding the processed electrical signals into the second electrical signal, an output transducer for transforming the second electrical signal into an acoustic output signal, and wherein the processor comprises a set of compressors each of which is connected to a different bandpass filter for compression of the corresponding bandpass filtered signal. The frequency ranges of the bandpass filters are also denoted channels.

It is presently preferred that the compression ratio is increased to at least 1.4, and more preferred to increase the compression ratio to approximately 2.

The at least one low frequency channel may further comprise an offset amplifier adding an offset gain to the compressor characteristic, and the method may further comprise the step of adjusting the offset gain in the range from −20 dB to 20 dB.

Accordingly, a hearing aid that has been fitted with the fitting method according to the present invention is provided with a compressor in a low frequency channel that compresses signals with a larger compression ratio than would have been set according to known fitting methods.

It is a characteristic feature of a compressor characteristic having been adjusted in accordance with the fitting method according to the present invention that the compression ratio, e.g. a compression ratio equal to 2, is maintained for a large range of the signal level at the input of the compressor. It is preferred that the signal level range starts at 30 dB SPL, more preferred at 25 dB SPL, still more preferred at 20 dB SPL, and even more preferred below 20 dB SPL. Preferably the range ends at 60 dB SPL, preferably at 70 dB SPL, more preferred at 80 dB SPL, and even more preferred above 80 dB SPL. The range may vary from one frequency band to another.

In accordance with the present invention, it has been recognized that the perception of the occlusion effect is caused by signals at low frequencies, such as frequencies below 1600 Hz, more pronounced below 1000 Hz, even more pronounced below 800 Hz, still more pronounced below 500 Hz. Thus, according to the present invention, a low frequency band comprises frequencies below 1600 Hz, preferably below 1000 Hz, more preferred below 800 Hz, and most preferred below 500 Hz.

BRIEF DESCRIPTION OF THE DRAWING

Still other objects of the present invention will become apparent to those skilled in the art from the following description wherein the invention will be explained in greater detail. By way of example, there is shown and described a preferred embodiment of this invention. As will be realized, the invention is capable of other different embodiments, and its several details are capable of modification in various, obvious aspects all without departing from the invention. Accordingly, the drawings and descriptions will be regarded as illustrative in nature and not as restrictive. In the drawings.

DETAILED DESCRIPTION OF PREFERRED EMBODIMENTS

Figure 1:
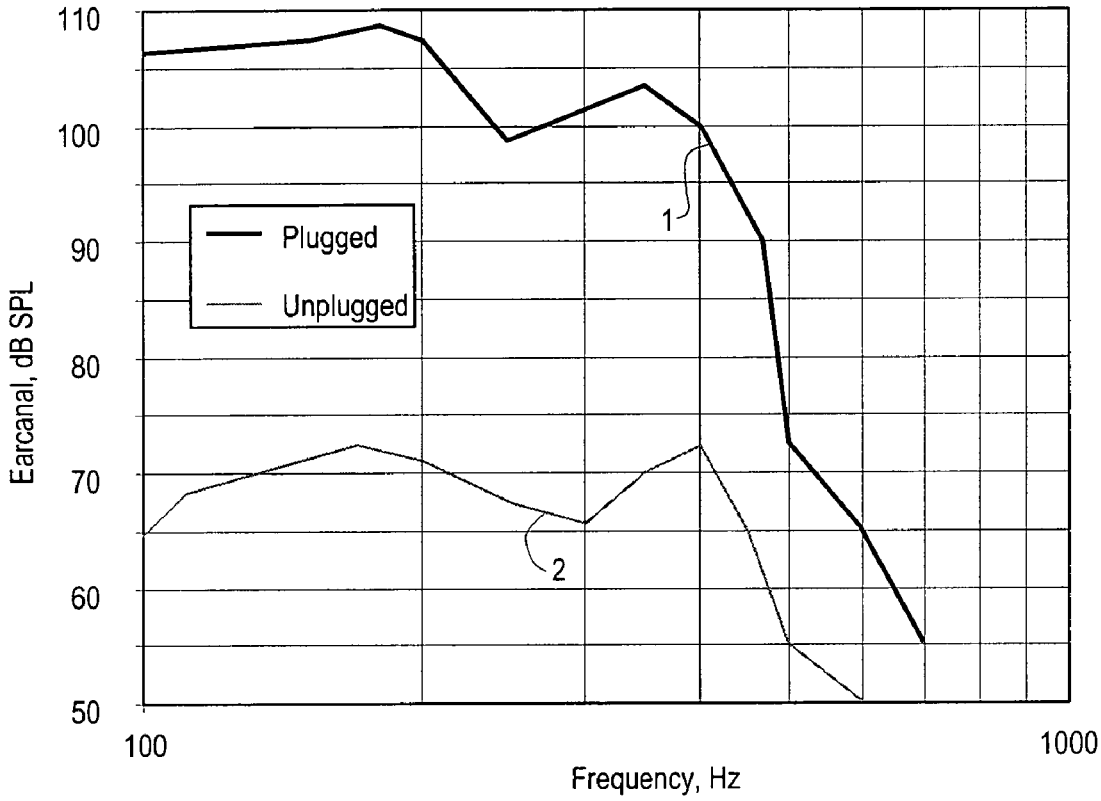
FIG. 1 shows plots of sound pressure level (SPL) in the occluded and non-occluded ear canal, respectively, as a function of frequency for a specific sound.
Figure 2:
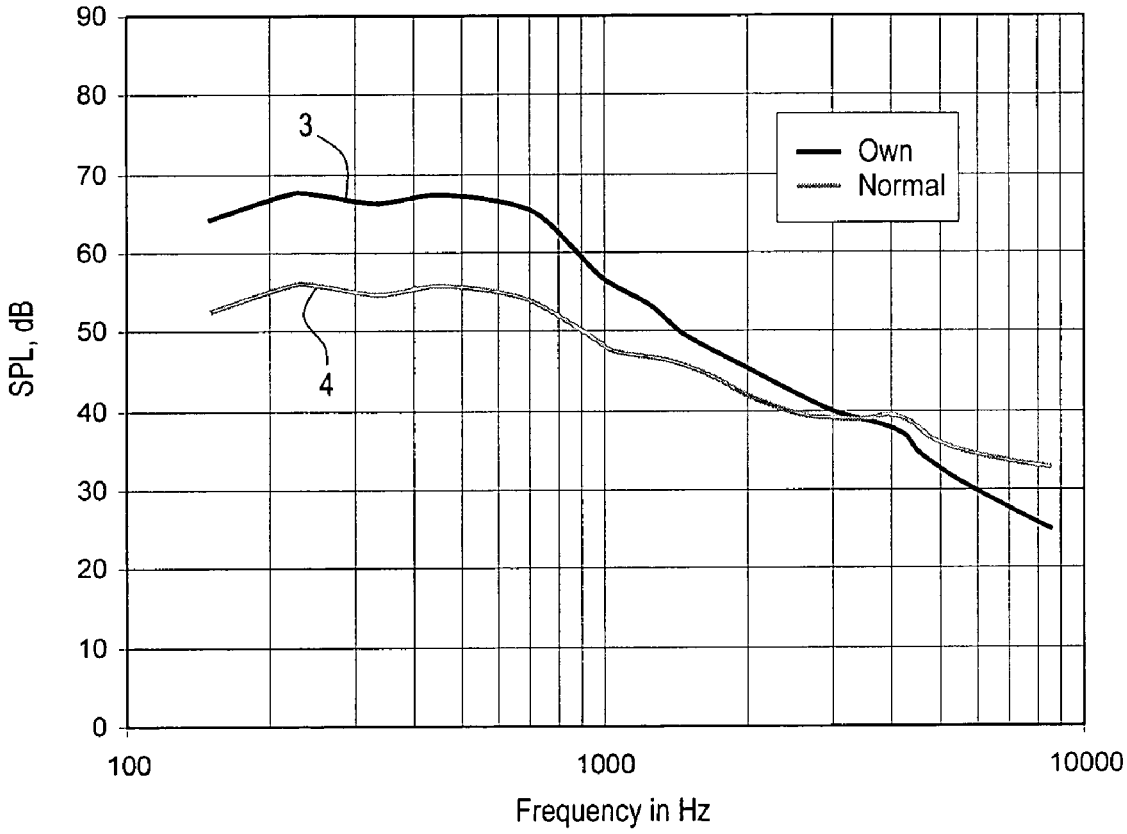
FIG. 2 shows plots of SPL generated by the person himself and generated by another person, respectively, in a non-occluded ear canal as a function of frequency.
Figure 3:
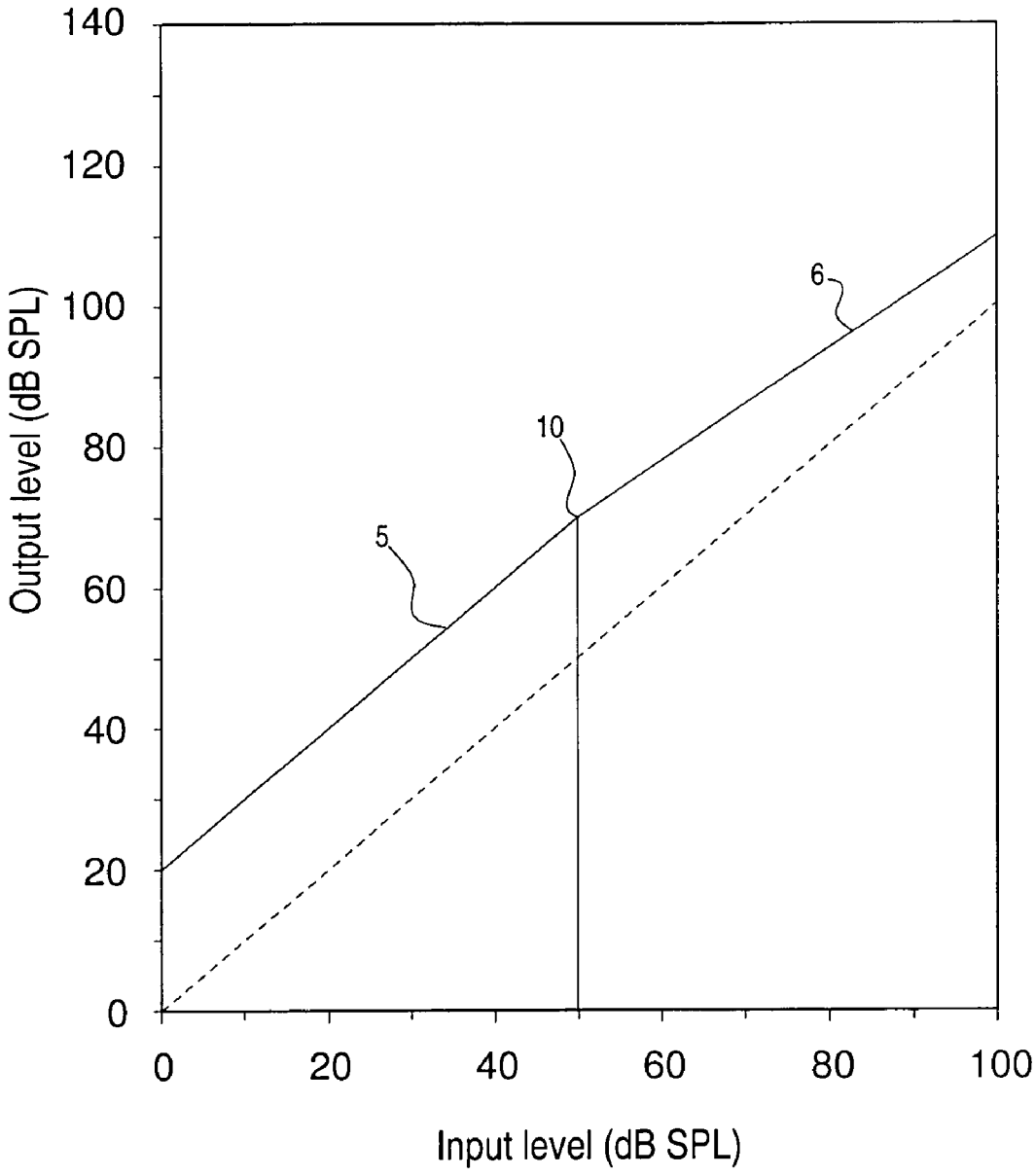
PRIOR ART Fig. 3
FIG. 3 shows a prior art compressor characteristic.

FIG. 3 shows a plot of a prior art compressor characteristic, i.e. a plot of the compressor output level as a function of the input level, both in SPL. The characteristic comprises two linear segments 5, 6, that are interconnected at a knee-point 10, typically positioned at 50 dB SPL input level. Below the knee point 10, the linear segment 7 has substantially no compression, i.e. the gain is a constant gain, suitable for compensating the hearing loss at low input signal levels. Above the knee point 10, the segment 6 has a compression ratio above 1, typically 2:1, for compensating for recruitment. Recruitment denotes the effect of a sensorineural hearing loss where loudness increases rapidly with increased sound pressure just above the hearing threshold and increases normally at high sound pressures. The hearing threshold is the lowest sound level at which sound is perceived. The compression ratio of a segment is equal to the reciprocal value of the slope of the segment. In a low frequency range, the hearing loss is typically moderate so that a known fitting method leads to a compressor characteristic with a low compression ratio, i.e. a compression ratio close to 1. This leads to a low attenuation of high level signals whereby the above-mentioned perceived occlusion effect occurs.

In FIG. 3, segment 7 has a compression ratio of 1, and segment 6 has a compression ratio of approximately 2 or 2:1.

Figure 4:
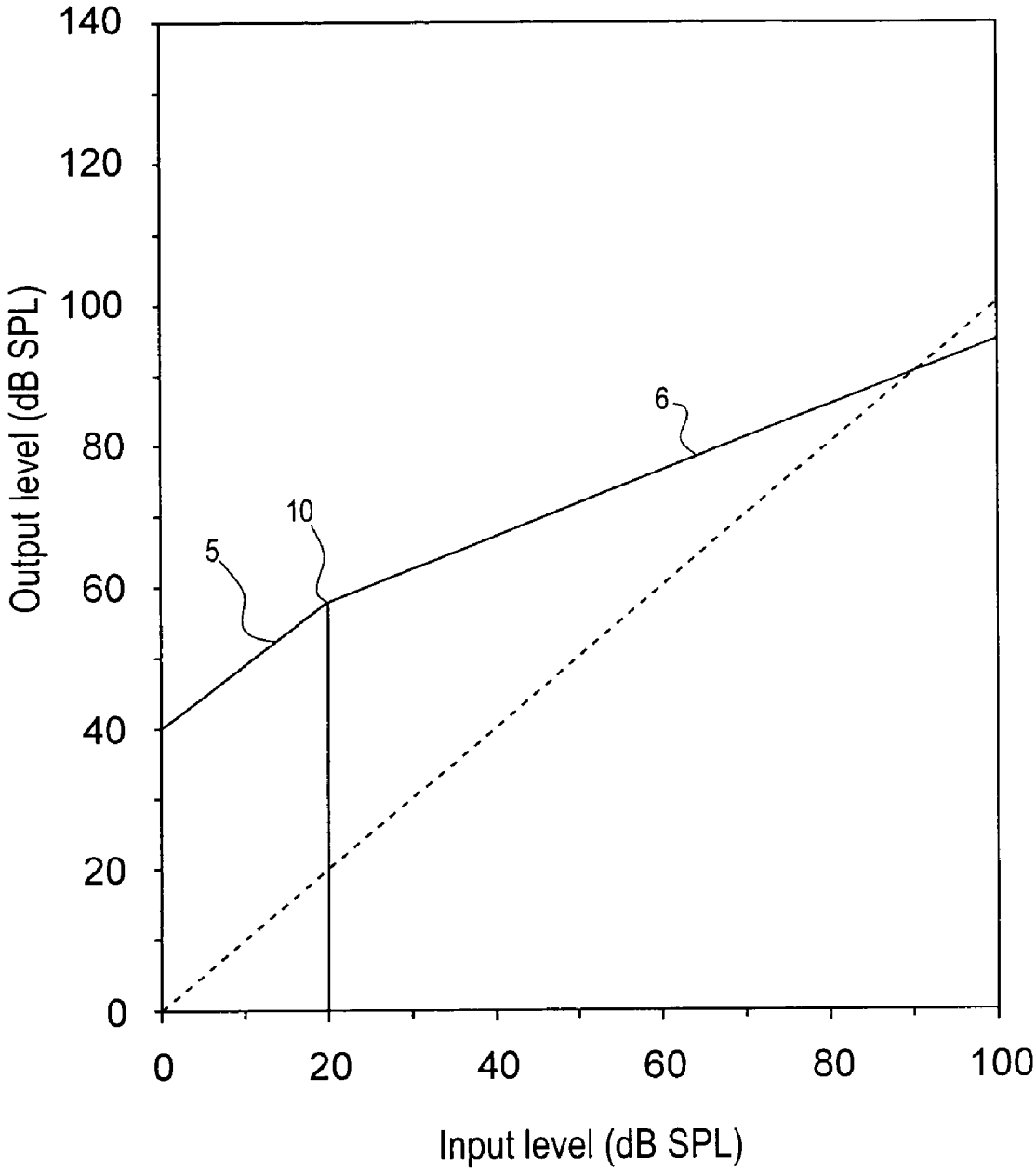
FIG. 4 shows a compressor characteristic according to the present invention.

FIG. 4 shows a compressor characteristic of a compressor according to the present invention. In accordance with the invention, signals with a high level, i.e. above signal levels of speech from another person, are compressed. In FIG. 4, the segments 5, 6 are identical to the segments 5, 6 shown in FIG. 3. Preferably, segment 6 has a compression ratio that is greater than 1.4, and, more preferred, a compression ratio is substantially equal to 2. Other values of the compression ratio may be used if appropriate. It is the gist of the present invention that compressors operating at low frequencies enhance low level signals and attenuate high level signals whereby perception of occlusion is suppressed. The compression ratio is constant in a large signal range, in the present example from 20 dB SPL to 100 dB SPL.

As mentioned above, in a low frequency range, the hearing loss is typically moderate so that a known fitting method leads to a compressor characteristic with a low compression ratio, i.e. a compression ratio close to 1. This leads to a low attenuation of high level signals whereby the above-mentioned perceived occlusion effect occurs. It is an important advantage of the present invention that a further step is added to a known fitting method that leads to an increase of the compression ratio, e.g. to a compression ratio that is greater than 1.4, e.g. equal to 2, whereby low frequency, high level signals are attenuated, alleviating the perceived occlusion effect.

Figure 5:
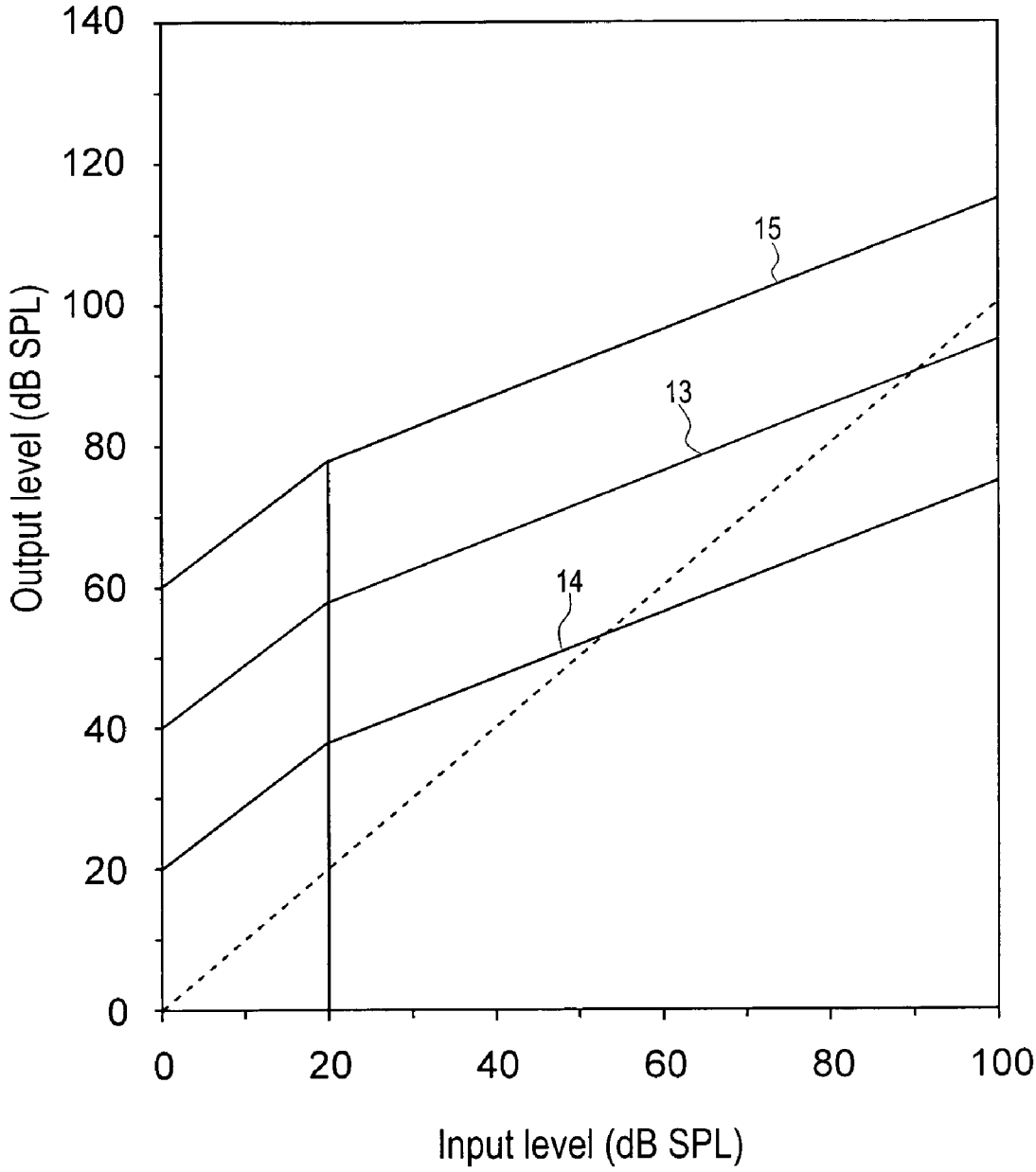
FIG. 5 illustrates fine tuning of the compressor characteristic according to the present invention.

Further, offset amplifiers are provided for adjusting the compressor characteristic in each of the low frequency channels subjected to compressions for reduction of the perception of occlusion of the ear canal. FIG. 5 shows such compressor characteristic adjustments as a displacement of the compressor characteristic. In FIG. 5, characteristic 13 corresponds to the characteristic shown in FIG. 4, and the characteristics 14 & 15 illustrate possible displacements in response to gain adjustments. It is preferred to provide compressor characteristic adjustment in the range from −20 dB to +20 dB.

It should be noted from FIG. 5 that the illustrated fine tuning of the compressor characteristic provides an adjustment of the balance between enhancement of low level signals and attenuation of high level signals at the frequencies at which the compressor in question operates.

Figure 6:
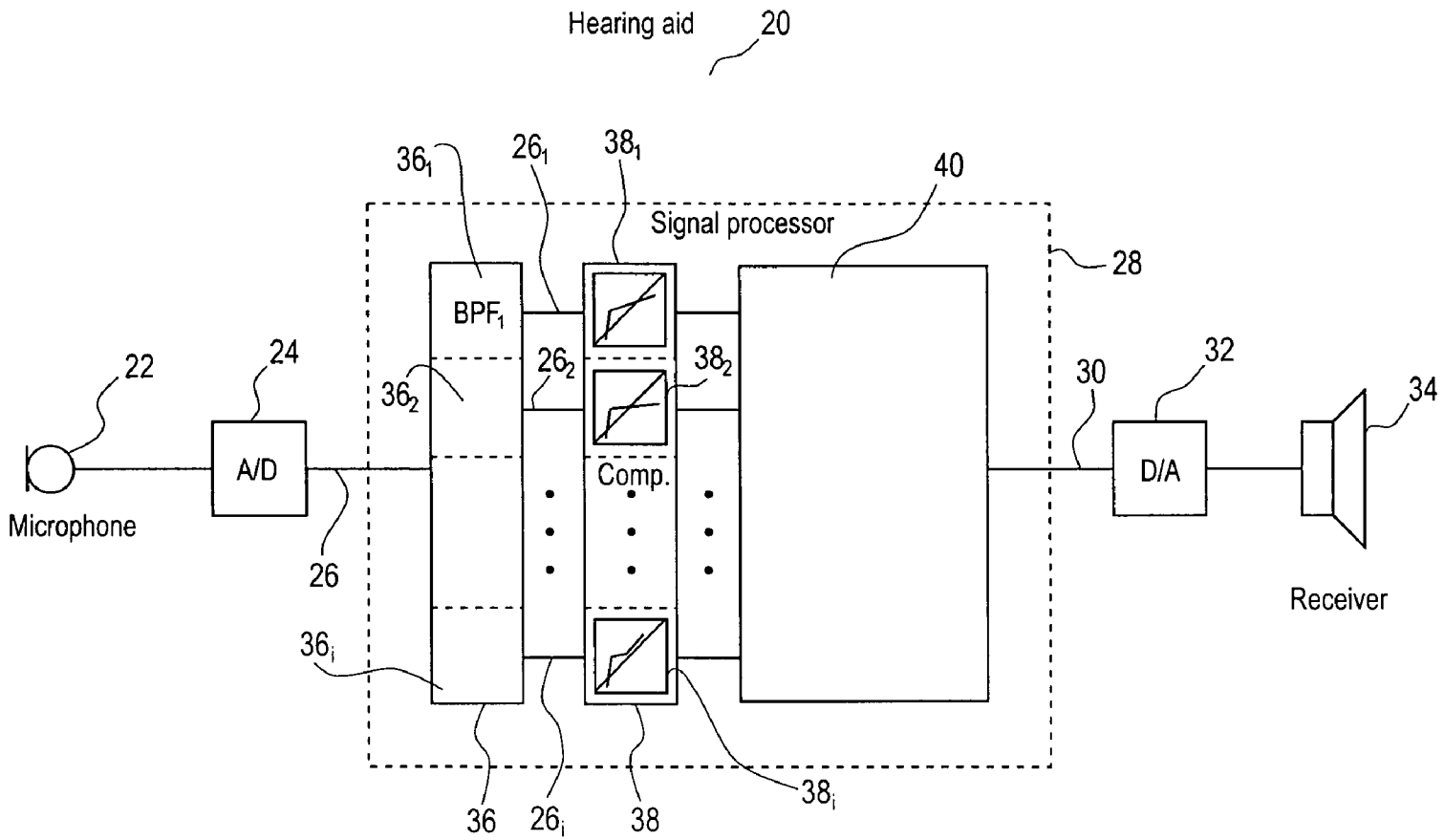
FIG. 6 shows a block-diagram of a hearing aid adapted for implementing the method according to the present invention.

FIG. 6 shows a schematic block diagram of a hearing aid 20 according to the present invention. It will be obvious for the person skilled in the art that the circuits indicated in FIG. 6 may be realized using digital or analogue circuitry or any combination hereof. In the preferred embodiment, digital signal processing is employed and thus, the processor 28 consists of digital signal processing circuits. In implementations of this embodiment, all the digital circuitry of the hearing aid 20 may be provided on a single digital signal processing chip or, the circuitry may be distributed on a plurality of integrated circuit chips in any appropriate way.

In the hearing aid 20, a microphone 22 is provided for reception of a sound signal and conversion of the sound signal into an electrical signal representing the received sound signal. The hearing aid 20 may comprise a plurality of input transducers 22, e.g. whereby a desired directional sensitivity characteristics may be provided. The microphone 22 converts the sound signal to an analogue signal. The analogue signal is sampled and digitized by an A/D converter 24 into a digital signal 26 for digital signal processing in the hearing aid 20. The digital signal 26 is fed to a digital signal processor 28 for amplification of the microphone output signal 26 according to a desired frequency characteristic and compressor function to provide an output signal 30 suitable for compensating the hearing deficiency of the user. The output signal 30 is fed to a D/A converter 32 and further to an output transducer 34, i.e. a receiver 34, that converts the output signal 30 to an acoustic output signal.

The signal processor 28 comprises a first filter bank 36 with bandpass filters $\mathbf{36}_i$ for dividing the electrical signal 26 into a set of bandpass filtered first electrical signals $\mathbf{26}_1$, $\mathbf{26}_2$, . . . , $\mathbf{26}_i$. Further, the signal processor 28 comprises a set 38 of compressors and offset amplifiers $\mathbf{38}_1$, $\mathbf{38}_2$, . . . , $\mathbf{38}_i$ each of which is connected to a respective bandpass filter $\mathbf{36}_1$, $\mathbf{36}_2$, . . . , $\mathbf{36}_i$ for individual compression of the corresponding bandpass filtered signals $\mathbf{26}_1$, $\mathbf{26}_2$, . . . , $\mathbf{26}_i$, the compressor and offset amplifiers 38, and 382 in the low frequency bands 36, and 362 having compression ratios that have been increased in accordance with the present invention.

The illustrated compressor characteristics $\mathbf{38}_1$ and $\mathbf{38}_2$ correspond to the characteristic shown in FIG. 4, and the characteristic $\mathbf{38}_i$ corresponds to the characteristic shown in FIG. 3. $\mathbf{36}_1$ and $\mathbf{36}_2$ are low frequency bandpass filters, e.g. with passbands below 500 Hz. $\mathbf{36}_1$ may have a passband below 300 Hz and $\mathbf{36}_2$ may have a passband between 300 Hz and 500 Hz.

In another embodiment of the invention, the set of compressors comprises four compressors with a compressor characteristic of the type shown in FIG. 4, i.e. each of the two bands described in the previous segment is divided into two frequency bands with a compressor operating in each band.

During fitting and/or fine tuning, compressors in neighboring bands may be grouped together for simultaneous adjustment of respective parameters. For simplicity, it is preferred that corresponding parameters of compressors in a specific group are adjusted to the same value.

The invention claimed is:

1. A method of fitting a multichannel hearing aid for a specific user, comprising:

identifying a low frequency channel corresponding to the specific user's own speech;

adjusting a characteristic of an individually adjustable compressor for the low frequency channel according to a hearing loss of the specific user to be compensated by the hearing aid, and modifying said compressor characteristic to attenuate the user's own speech through increasing a compression ratio of said compressor characteristic in said low frequency channel wherein a low frequency band that includes the low frequency channel comprises frequencies below 800 Hz.

2. The fitting method according to claim 1, wherein the increased compression ratio is greater than 1.4.

3. The fitting method according to claim 1, wherein the increased compression ratio is substantially equal to 2.

4. The fitting method according to claim 1, wherein each of the hearing aid channels comprises an individually adjustable compressor and an offset amplifier.

5. The fitting method according to claim 1, wherein a range of signal levels at which the compression is active extends from 30 dB SPL to 60 dB SPL.

6. The fitting method according to claim 1, wherein a range of signal levels at which the compression is active extends from below 20 dB SPL and to 70 dB SPL.

7. The fitting method according to claim 1, wherein a range of signal levels at which the compression is active is selected in respective frequency bands.

8. A method of fitting a multichannel hearing aid for a specific user, comprising:

identifying a low frequency channel corresponding to the specific user's own speech;

adjusting a characteristic of an individually adjustable compressor for the low frequency channel according to a hearing loss to be compensated by the hearing aid, modifying said compressor characteristic to increase a compression ratio of said compressor characteristic in said low frequency channel to attenuate the user's own speech, adding an offset gain for displacement of said compressor characteristic, and adjusting the offset gain in the range from −20 dB to 20 dB wherein a low frequency band that includes the low frequency channel comprises frequencies below 800 Hz.

9. The fitting method according to claim 8, wherein the increased compression ratio is greater than 1.4.

10. The fitting method according to claim 8, wherein the increased compression ratio is substantially equal to 2.

11. The fitting method according to claim 8, wherein each of the hearing aid channels comprises an individually adjustable compressor and an offset amplifier.

* * * * *